United States Patent [19]

Kamiya

[11] Patent Number: 4,581,249

[45] Date of Patent: Apr. 8, 1986

[54] PHOTOCHEMICAL VAPOR DEPOSITION METHOD

[75] Inventor: Osamu Kamiya, Machida, Japan

[73] Assignee: Canon Kabushiki Kaisha, Tokyo, Japan

[21] Appl. No.: 714,575

[22] Filed: Mar. 21, 1985

[30] Foreign Application Priority Data

Mar. 30, 1984 [JP] Japan ..... 62959

[51] Int. Cl.[4] ..... B05D 3/06

[52] U.S. Cl. ..... 427/53.1; 427/54.1; 427/55

[58] Field of Search ..... 427/53.1, 54.1, 55, 427/255.2; 118/724; 250/494.1, 495.1; 204/DIG. 11

[56] References Cited

U.S. PATENT DOCUMENTS

| | | | |
|---|---|---|---|
| 4,009,364 | 2/1977 | Ladstädter | 427/53.1 X |
| 4,059,461 | 11/1977 | Fan et al. | 427/53.1 X |
| 4,104,438 | 8/1978 | Angeld et al. | 427/255.2 X |
| 4,181,751 | 1/1980 | Hall et al. | 427/53.1 |
| 4,324,854 | 4/1982 | Beauchamp et al. | 427/54.1 X |
| 4,371,587 | 2/1983 | Peters | 427/54.1 X |
| 4,401,689 | 8/1983 | Ban | 427/45.1 |
| 4,435,445 | 3/1984 | Allred et al. | 427/54.1 |
| 4,447,469 | 5/1984 | Peters | 427/54.1 |
| 4,490,211 | 12/1984 | Chen et al. | 156/643 |
| 4,522,845 | 6/1985 | Powell et al. | 427/53.1 |

*Primary Examiner*—Thurman K. Page

*Attorney, Agent, or Firm*—Fitzpatrick, Cella, Harper & Scinto

[57] ABSTRACT

A photochemical vapor deposition method comprises introducing a starting gas into a reaction chamber, irradiating the starting gas with a light energy, and forming a deposition film on a substrate by utilizing a photochemical reaction, characterized in that the plural starting gases are introduced into the reaction chamber and the film is formed on said substrate by causing chemical reactions by irradiating molecules of these starting gases with individual light energy having a wavelength region corresponding to an absorption spectrum of each of said starting gas.

A photochemical vapor deposition method comprises introducing a starting gas into a reaction chamber, irradiating the starting gas with a light energy, and forming a deposition film on a substrate by utilizing a photochemical reaction, characterized in that the starting gas is introduced into the reaction chamber and the deposition film is formed on the substrate by causing a chemical reaction by irradiating with light energy having a wavelength region corresponding to an absorption spectrum of said starting gas and irradiating with light energy having gas and irradiating with light energy having a wavelength region corresponding to an absorption spectrum of chemical substance produced from said starting gas.

3 Claims, 2 Drawing Figures

PHOTOCHEMICAL VAPOR DEPOSITION METHOD

BACKGROUND OF THE INVENTION

1. Field of the Invention

This invention relates to a photochemical vapor deposition method, and more particularly to a novel process for producing a photochemical vapor deposition thin film by which a thin film of high purity can be formed at a low temperature using a photochemical reaction.

2. Description of the Prior Art

A photochemical vapor deposition apparatus (hereinafter abbreviated as PCVD apparatus) is an apparatus which includes a reaction chamber, a means for introducing starting gas into the reaction chamber and a means for irradiating the starting gas with a light of high energy and by which a thin film is deposited on a substrate placed in the reaction chamber by utilizing the photochemical reaction.

FIG. 1 shows a basic construction of a representative PCVD apparatus employed in the prior art. In FIG. 1, 1 is luminous flux, 2 a window, 3 a reaction chamber, 4 a valve for introducing starting gas, 5 a thin film, 6 a substrate, and 7 an outlet.

The conventional PCVD apparatus of this type can form a film by decomposing the starting gas by use of light energy. For example, there is known a process in which a silane gas introduced into reaction chamber 3 is irradiated with light of high energy such as excimer laser and the like to form a silicon hydride film on the substrate. In this process, since the film is formed only by use of light energy, there were defects that the deposition rate is low, the bonding between silicon atoms and hydrogen atoms does not sufficiently proceed and electrical properties of the film formed in insufficient.

For example, the reactions such as those mentioned below may be supposed as the possible reactions for forming silicon hydride by the decomposition of silane gas.

$$SiH_4^* \rightarrow Si^* + 2H_2$$

$$SiH_4^* \rightarrow SiH^* + H_2 + H$$

(* shows an excited state.)

However, energy needed for each dissociation reaction is different from each other. Therefore, it is difficult to treat all of these dissociation reactions only by a light having a single wavelength.

SUMMARY OF THE INVENTION

An object of the present invention is to provide a photochemical vapor deposition method which can overcome the defects of the conventional photochemical vapor deposition method as described above, deposite a film at a higher deposition rate, form a thin film of a compound and also form a thin film having excellent electrical and mechanical properties and which makes it possible to pattern the film easily.

According to one aspect of the present invention, there is provided a photochemical vapor deposition method which comprises introducing a starting gas into a reaction chamber, irradiating the starting gas with a light energy, and forming a deposition film on a substrate by utilizing a photochemical reaction, characterized in that the plural starting gases are introduced into the reaction chamber and the film is formed on said substrate by causing chemical reactions by irradiating molecules of these starting gases with individual light energy having a wavelength region corresponding to an absorption spectrum of each of said starting gases.

According to another aspect of the present invention, there is provided a photochemical vapor deposition method which comprises introducing a starting gas into a reaction chamber, irradiating the starting gas with a light energy, and forming a deposition film on a substrate by utilizing a photochemical reaction, characterized in that the starting gas is introduced into the reaction chamber and the deposition film is formed on the substrate by causing a chemical reaction by irradiating with light energy having a wavelength region corresponding to an absorption spectrum of said starting gas and irradiating with light energy having a wavelength region corresponding to an absorption spectrum of chemical substance produced from said starting gas.

DESCRIPTION OF THE PREFERRED EMBODIMENTS

Figure 1:
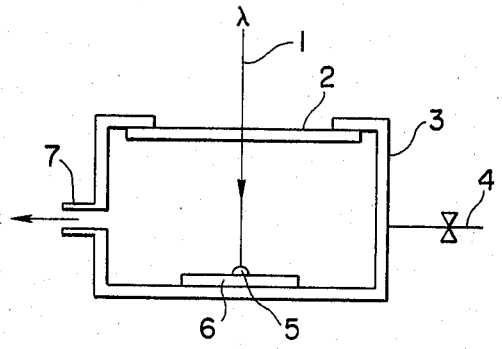
FIG. 1 shows schematically a conventional photochemical vapor deposition apparatus.
Figure 2:
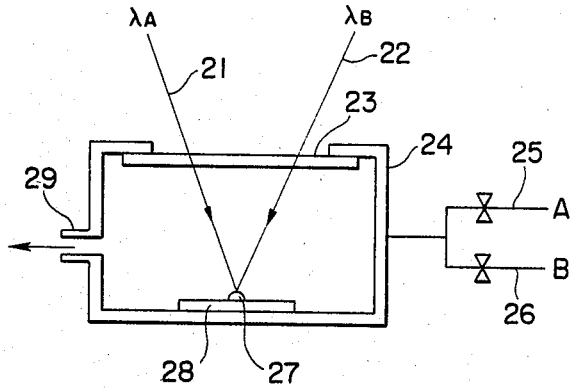
FIG. 2 schematically shows an example of a photochemical vapor deposition apparatus used for carrying out the process of the present invention.

FIG. 2 shows schematically an example of an apparatus for effecting the process of the present invention.

In FIG. 2, 21 is luminous flux of wavelength $\lambda_A$ and 22 is luminous flux of wavelength $\lambda_B$. These luminous fluxes irradiate simultaneously the substrate 28 placed in the reaction chamber 24. At the same time, starting gases A and B are flowed into the reaction chamber through the values 25 and 26, respectively, while exhausting these gases from the outlet 29.

Wavelengths $\lambda_A$ and $\lambda_B$ are determined by selecting wavelength for activating the starting gases A and B, respectively.

The thin film 27 of the compound AB is deposited on a portion of the surface of the substrate 28, and the light $\lambda_A$ and $\lambda_B$ are impinged on the thin film in a manner to meet at one portion.

In the above described case, the gases of SiH, $SiH_2$, $H_2$, H and so on produced by decomposition of $SiH_4$ were irradiated with the plural lights each having a wavelength conforming to these gases types. However, it may also be contemplated that the different starting gases are separately introduced and the introduced gases are irradiated with the plural lights each having a wavelength conforming to these gases.

That is, methane gas and silane gas are introduced simultaneously into the reaction chamber and these gases are irradiated simultaneously with infrared rays of about 3.3$\mu$ for excitation of methane gas and ultraviolet rays such as excimer laser and the like for the decomposition of silane gas to form a SiC film as compound produced from both gases.

Irradiation light and the starting gases are not limited to two types, respectively, and many types of the gases or many types of the light having respective wavelength may be used. Thereby, the reaction may be further promoted effectively.

For example, during formation of a silicon hydride film by decomposition of silane gas, hydrogen and SiH, $SiH_2$ or the like are irradiated simultaneously according to the present invention with the ultraviolet rays necessary to excite hydrogen and the infrared rays available to excite SiH, $SiH_4$ or the like to deposite silicon hydride at a higher deposition rate, to increase bonding strength to hydrogen, and to make it possible to improve electrical properties of the silicon hydride film.

By executing the means as described above, effects as described below are obtained.

(1) By the increase of the reaction rate, the deposition rate of the film according to the present invention is faster than that according to the conventional means.

(2) The compound thin film is formed easily.

(3) The electrical and mechanical properties of the film are improved by the increase of the bonding strength between the compounds.

(4) The film is formed locally on the portion and the plural lights are impinged on the thin film in a manner to meet at one portion.

Thereby the film can be patterned easily.

EXAMPLE $SiH_4$ gas and $CH_4$ gas of a volume ratio of 1:1 were introduced into the reaction chamber at a flow rate of 150 SCCM, respectively. Using a light source including light of wavelength 4.58$\mu$ as the absorption light of $SiH_4$ gas within the wavelength region of emitted light and using a light source including light of wavelength 3.31$\mu$ as the absorption light of $CH_4$ gas within the wavelength region of emitted light the surface of a glass substrate provided with an electroconductive film of ITO on its substrate which was placed in advance in the reaction chamber was irradiated with the light from these light sources for two hours to form a deposition film of 2.1$\mu$ on its surface. During the film deposition, the temperature of the substrate was 200° C. By investigation of a composition of the deposition film formed on the glass substrate, it was confirmed that the deposition film was composed of an amorphous hydrogenated silicon carbide film. By measurement of electric resistance of the deposition film, it was confirmed that the film is a good insulator.

What is claimed is:

1. A photochemical vapor deposition method which comprises introducing a starting gas into a reaction chamber, irradiating the starting gas with a light energy, and forming a deposition film on a substrate by utilizing a photochemical reaction, characterized in that the plural starting gases are introduced into the reaction chamber and the film is formed on said substrate by causing chemical reactions by irradiating molecules of these starting gases with individual light energy having a wavelength region corresponding to an absorption spectrum of each of said starting gases.

2. A photochemical vapor deposition method according to claim 1 wherein one of starting gases is $SiH_4$ gas and another gas is $CH_4$.

3. A photochemical vapor deposition method which comprises introducing a starting gas into a reaction chamber, irradiating the starting gas with a light energy, and forming a deposition film on a substrate by utilizing a photochemical reaction, characterized in that the starting gas is introduced into the reaction chamber and the deposition film is formed on the substrate by causing a chemical reaction by irradiating with light energy having a wavelength region corresponding to an absorption spectrum of said starting gas and irradiating with light energy having a wavelength region corresponding to an absorption spectram of chemical substance produced from said starting gas.

* * * * *

UNITED STATES PATENT AND TRADEMARK OFFICE

CERTIFICATE OF CORRECTION

PATENT NO. : 4,581,249

DATED : APRIL 8, 1986

INVENTOR(S) : OSAMU KAMIYA

It is certified that error appears in the above-identified patent and that said Letters Patent is hereby corrected as shown below:

AT [57] IN THE ABSTRACT

Line 11, "starting gas." should read --starting gases.--.

COLUMN 1

Line 37, "in" should read --is--.

COLUMN 2

Line 39, "values" should read --valves--.
Line 51, "these gases type." should read --these gas types.--.

COLUMN 4

Line 35, "spectram" should read --spectrum--.

Signed and Sealed this

Seventeenth Day of March, 1987

*Attest:*

DONALD J. QUIGG

*Attesting Officer*

*Commissioner of Patents and Trademarks*